US006357460B1

(12) United States Patent
Bertsch et al.

(10) Patent No.: US 6,357,460 B1
(45) Date of Patent: Mar. 19, 2002

(54) DISHWASHER SPRAY ARM AND FEED SYSTEM

(75) Inventors: Roger J. Bertsch, Stevensville; Geoffrey L. Dingler, St. Joseph, both of MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/434,223

(22) Filed: Nov. 5, 1999

(51) Int. Cl.[7] ..... B08B 3/02
(52) U.S. Cl. ..... 134/174; 134/176; 134/179
(58) Field of Search ..... 134/199, 198, 134/174, 176, 179, 180

(56) References Cited

U.S. PATENT DOCUMENTS

| | | | | | |
|---|---|---|---|---|---|
| 2,704,082 | A | * | 3/1955 | Jackson | 134/176 |
| 3,841,342 | A | | 10/1974 | Cushing et al. | 134/144 |
| 4,004,600 | A | | 1/1977 | Corn et al. | 134/57 |
| 4,134,414 | A | | 1/1979 | Jarvis et al. | 134/144 |
| 4,172,463 | A | | 10/1979 | Woolley et al. | 134/176 |
| 4,174,723 | A | | 11/1979 | Long | 134/144 |
| 5,211,190 | A | | 5/1993 | Johnson et al. | 134/180 |
| 5,449,011 | A | | 9/1995 | Jacobus et al. | 134/176 |
| 5,494,062 | A | * | 2/1996 | Springer | 134/199 |
| 5,673,716 | A | * | 10/1997 | Gurubatham et al. | 134/179 |
| 5,725,002 | A | * | 3/1998 | Payzant | 134/179 |
| 5,730,805 | A | | 3/1998 | Bertsch | 134/10 |
| 5,823,211 | A | | 10/1998 | Wilhelmstatter et al. | 134/176 |

FOREIGN PATENT DOCUMENTS

| | | | | |
|---|---|---|---|---|
| CH | 423120 | * | 4/1967 | 134/176 |
| CH | 428116 | * | 7/1967 | 134/176 |
| DE | 2911005 | * | 9/1980 | 134/199 |
| DE | 3702828 | | 4/1988 | A47L/15/23 |
| DE | 19642911 | | 4/1998 | A47L/15/23 |
| FR | 2409740 | * | 7/1979 | 134/176 |
| GB | 2200535 | * | 8/1988 | 134/198 |
| JP | 5-146389 | * | 6/1993 | 134/198 |
| NO | 70812 | * | 6/1943 | 134/198 |

OTHER PUBLICATIONS

European Patent Application 321,025 Jun. 1989 134/198.*

* cited by examiner

*Primary Examiner*—Frankie L. Stinson
(74) *Attorney, Agent, or Firm*—Joel M. Van Winkle; Robert O. Rice; Stephen Krefman

(57) ABSTRACT

A dishwasher having a tub which includes a bottom sump and a side wall wherein a first dishware rack is supported within the tub and a second dishware rack is supported within the tub above the first dishware rack. A pump is provided for drawing wash liquid from the sump for pumping wash liquid through a pump outlet. A hub member is attached to the spray arm and extends downwardly from the spray arm. The hub member includes a bearing flange surface. A cap member which is connectable to the pump outlet has an annular bearing surface arranged between the bearing flange surface and the spray arm. The cap member is connectable to a housing wall provided about the pump outlet without the use of fasteners such that the spray arm may be readily connected to the pump outlet. The cap member is further provided with a discharge conduit. A supply line extends from the discharge conduit and is secured to the tub. A second spray arm is supported above the first dishware rack and receives wash liquid through the supply line.

16 Claims, 3 Drawing Sheets

DISHWASHER SPRAY ARM AND FEED SYSTEM

BACKGROUND OF THE INVENTION

1. Field of the Invention

This invention relates generally to dishwashers of the household type and more particularly to a spray arm bearing support system for a lower spray arm which incorporates a feed system for an upper level spray system.

2. Description of the Related Art

Nearly all domestic dishwashers include a lower wash arm that rotates about a vertical axis. Most of the larger dishes are carried on a lower rack which rolls on wheels on ledges formed on the sides of the tub and out onto the fold down front door. An upper rack is also provided for smaller articles including cups and glasses, and it is mounted on rollers and tracks to also be moveable in or out of the tub for loading and unloading. It has been found that a single rotary lower wash arm does not always give good washability performance because the spray path can be blocked by dishes on the lower rack and very little water may reach some articles on the upper rack. Therefore, nearly all dishwashers include an upper or second level spray mechanism to provide a spray both upward and downward beneath the upper rack to spray upward directly on the articles in the upper rack and downwardly on to the articles on the lower rack.

Lower spray arms are generally mounted directly above the recirculation pump and receive wash liquid directly therefrom. Different approaches have been taken to rotatably support a lower spray arm and provide a thrust bearing surface. For example, U.S. Pat. Nos. 3,866,837 and 5,427,129 disclose different spray arm bearing support systems.

The upper rack spray system may include a rotating wash arm similar to the main or lower wash arm which may be mounted directly to the upper rack and receive wash liquid through an upper arm feed system. Different approaches have been taken to feed and rotatably support upper spray arms. One approach for an upper arm feed system is to utilize a tower mounted to the lower rack which receives wash liquid from the lower spray arm and has an open upper end such that wash liquid is sprayed through the tower upwardly into a bottom inlet in the upper spray arm for supplying the upper arm with wash liquid. U.S. Pat. No. 5,330,102 discloses a center tower type system for feeding an upper spray arm having a bottom inlet.

Another approach to supplying wash liquid to an upper rack spray system is to feed wash liquid to an upper spray arm through an liquid conduit which is mounted on the exterior of the dishwasher tub. U.S. Pat. Nos. 4,172,463, 4,004,600 and 5,211,190 are all examples of this type of approach. Generally, a discharge outlet from the wash pump is provided which is connected to an liquid conduit which is routed along the exterior of the dishwasher tub. The liquid conduit passes through the tub back into the wash chamber in an area near the upper rack to feed wash liquid to the upper spray arm.

The upper spray arm of a dishwasher may also be fed through the use of an internally disposed supply conduit. In such case, the wash pump of a dishwasher may be provided with a discharge outlet for supplying a conduit which extends along the inside surface of the dishwasher tub to a location near the upper dishwasher rack to feed wash liquid to the upper spray arm. One of the problems with systems that utilize internal conduit systems for supplying wash liquid to the upper spray arm is that the dishwasher wash pumps must be provided with two outlets—a lower spray arm outlet and an upper spray arm outlet.

It can be appreciated from a review of the prior art spray arm systems that there exists a need for simple, low cost and effective spray arm support system which maximizes the dishrack capacity. Moreover, there exists a need for a spray arm system which provides for wash liquid feed to both a lower spray arm and an upper spray arm in a simple, cost effective manner.

SUMMARY OF THE INVENTION

By the present invention, there is provided a dishwasher having a tub having a bottom sump and a side wall wherein a first dishware rack is supported within the tub and a second dishware rack is supported within the tub above the first dishware rack. A pump is provided for drawing wash liquid from the sump for pumping wash liquid through a pump outlet. A cap member rotatably connects a first spray arm to the pump outlet such that the first spray arm is rotatably supported above the pump and below the first dishware rack. The cap member is provided with a discharge conduit. A supply line extends from the discharge conduit and is secured to the tub. A second spray arm is supported above the first dishware rack and receives wash liquid through the supply line.

The present invention further provides a dishwashing machine including a tub for receiving articles to be washed and a pump for spraying wash liquid within the tub such that wash liquid is recirculated within the tub. A cap member is arranged in the bottom of the tub for defining a main wash liquid outlet for the pump. A spray arm is disposed within the tub above the cap member. A hub member is attached to the spray arm and extends downwardly from the spray arm. The hub member includes a cylindrical bearing surface. The cap member has an annular bearing surface arranged between the cylindrical bearing surface and the spray arm such that the spray arm is rotatably supported by the cap member. The cap member further has a discharge outlet conduit wherein a portion of the wash liquid supplied to the cap is directed through the discharge outlet away from the main liquid outlet. The discharge outlet fluidly connects to an supply tube for supplying wash liquid to a second spray arm mounted within the tub.

DESCRIPTION OF THE PREFERRED EMBODIMENT

Figure 1:
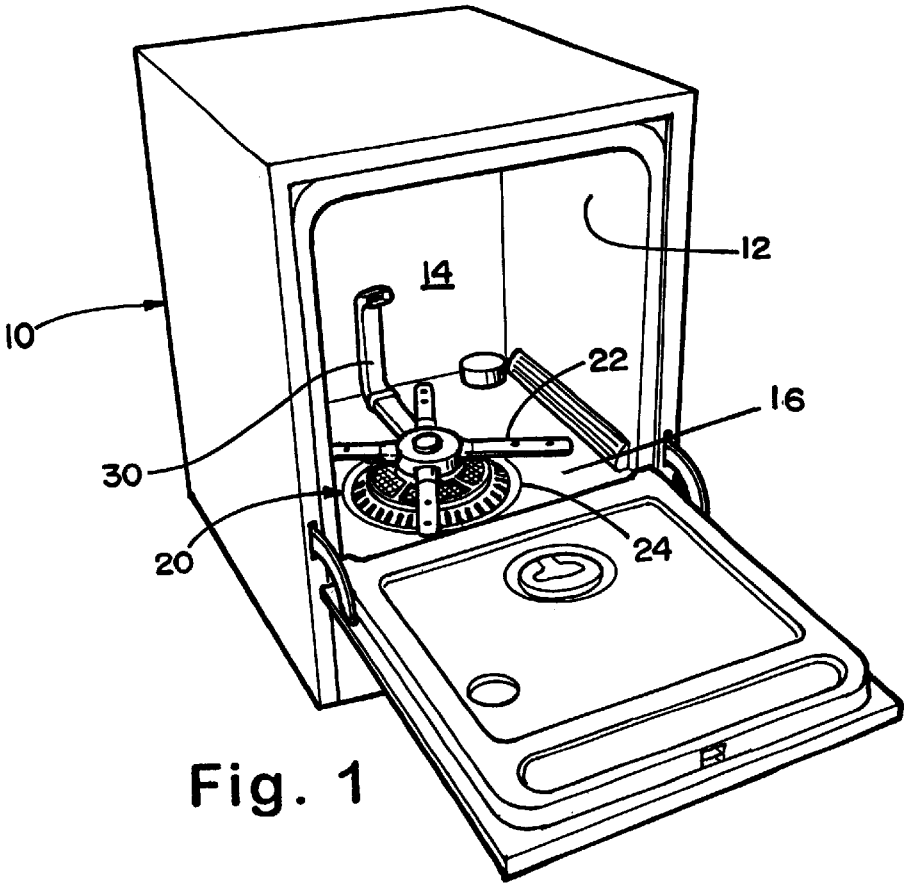
FIG. 1 is a perspective view of a dishwasher including a spray arm system in accordance with the present invention.
Figure 2:
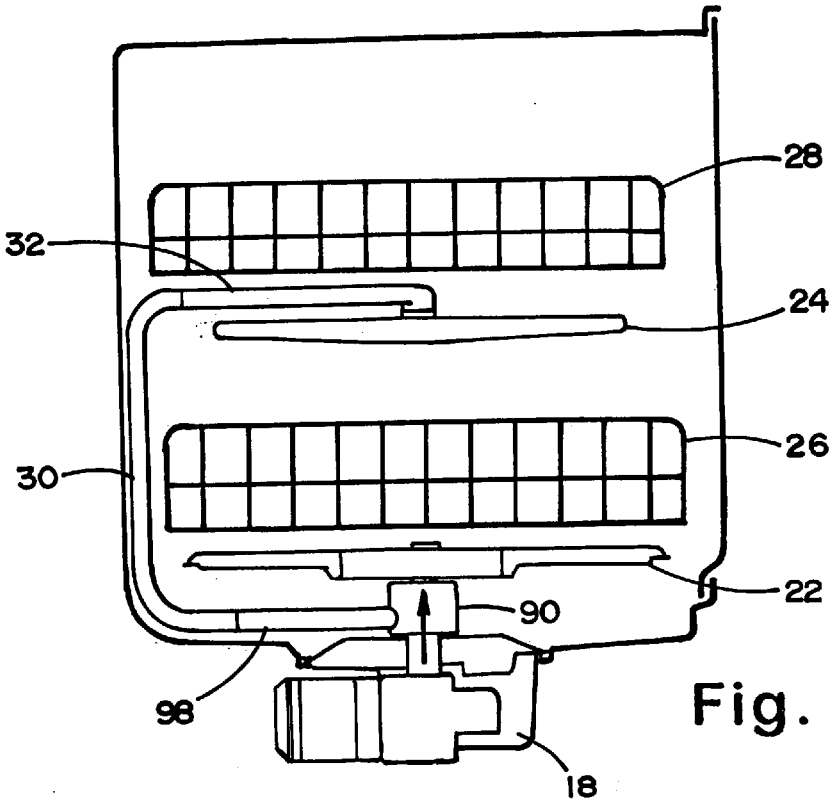
FIG. 2 is a schematic, cross-sectional view of the dishwasher of FIG. 1, showing the dishracks mounted within the tub and the upper spray arm feed system.

In accordance with the invention as shown in the drawings, and particularly as shown in FIGS. 1 and 2, an automatic dishwasher generally designated 10 includes an interior tub 12 forming an interior wash chamber or dishwashing space 14. The tub 12 includes a sloped bottom wall 16 which defines a lower tub region or sump of the tub. A pump assembly 20 is centrally located in the bottom wall 16 and operates to draw wash liquid from the sump and pump it to a lower spray arm assembly 22 and an upper spray arm assembly 24. The lower spray arm 22 is positioned beneath lower dishware rack 26 and the upper spray arm assembly is positioned below an upper dishware rack 28.

The lower spray arm assembly 22 is mounted to the upper portion of the pump assembly 20 as described and claimed further herein. A supply tube 30 extends from the pump assembly 20 within the tub 12 and supplies wash liquid to the upper spray arm 24. The upper spray arm 24 may be mounted to the upper rack 28. The supply tube 30 extends generally rearwardly from the pump assembly 20 to the rear wall of the tub and then runs upward to a predetermined height. The upper spray arm 24 includes a rear feed tube 32 which fluidly connects with the supply tube 30.

The basic constructional features of the pump assembly 20 are shown and described in U.S. application Ser. No. 09/326,280, to Jozwiak et al., herein incorporated by reference. In that application, the operation of a pump assembly 20 is fully explained.

Figure 3:
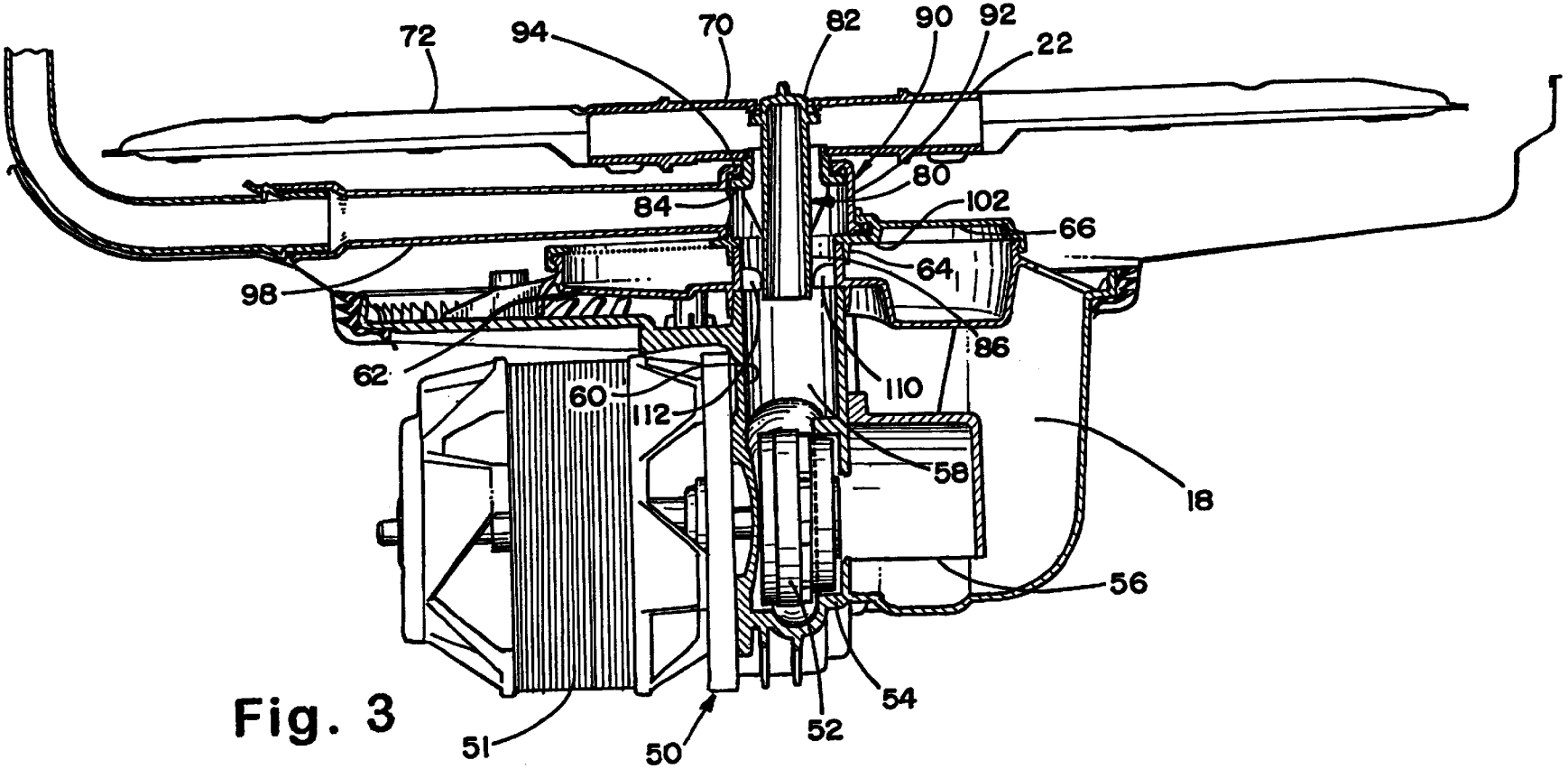
FIG. 3 is a sectional view of a dishwasher spray arm support system according to the present invention.

FIG. 3 illustrates an embodiment of the lower spray arm system according to the present invention. As can be seen, the pump assembly 20 includes a recirculation pump 50 including a motor 51 for driving an impeller 52 disposed within a pump chamber 54. When the motor 51 is energized, the impeller 52 rotates and draws wash liquid into a pump inlet 56 from the sump 18 and pumps the wash liquid upwardly through a pump outlet 58. A conduit 60, formed into the body of a soil collection chamber 62, and an inner portion 64 of a top housing wall 66 forms part of the pump outlet 58 such that the pump outlet 58 extends upwardly toward the lower spray arm assembly 22.

In the shown embodiment, the conduit 60 and the wall 64 are part of the soil collection chamber 62. However, it can be readily appreciated by one skilled in the art that the present invention may be practiced on dishwashers that do not include a soil collector. In the present embodiment, the conduit 60 and the inner portion of the wall 64 simply form part of—or are extensions of—the pump outlet 58. All dishwashers having a recirculation pump have an equivalent pump outlet structure. For example, a dishwasher may have a pump outlet which is formed as part of the upper wall of the pump, or the pump outlet may be configured to be formed as part of a filter wall disposed above the pump, or any other equivalents. It should be understood that as used herein, and in the appended claims, the term pump outlet is used broadly to encompass all portions of any elements which form part of the conduit or passage way through which liquid is pumped from a pump of pump chamber toward the lower spray arm assembly.

Figure 4:
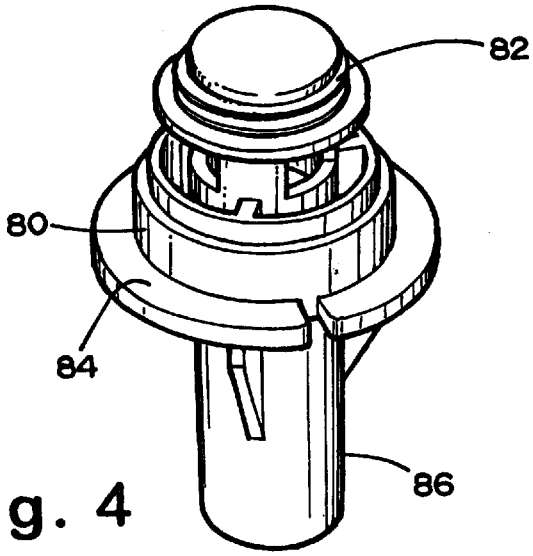
FIG. 4 is a perspective view of a hub member which forms part of the spray arm bearing support assembly of the present invention.

The spray arm assembly 22 is connected to the pump outlet 58 such that the spray arm assembly 22 can receive wash liquid from the pump outlet 58 and rotate within the tub 12 spraying wash liquid throughout the tub 12. The spray arm assembly 22 includes a distributor hub 70 having a plurality of spray arms 72 attached thereto. Alternatively, the spray arm may be formed as a single integral member having a central body and spray arms. A hub 80, shown in detail in FIG. 4, engages the distributor hub 70 and extends downwardly therefrom. The hub 80 is a generally tubular, elongated body having a top portion 82, a central bearing flange 84 and a cylindrical bottom portion 86. The top portion includes at least one thread for threadingly engaging the distributor hub 70. However, the hub 80 may connect to the spray arm assembly in any know manner.

A cap member 90 is connected to the spray arm assembly 22 by the hub 80. The cap member 90, shown in detail in FIG. 5, has a cylindrical main body portion 92 having an upper bearing flange 94 and a plurality of locking tabs 96. During assembly of the spray arm 22, the hub 80 and cap member 90, prior to connecting the hub 80 to the distributor body 70, the top portion 82 of the hub 80 is passed through the cylindrical main body portion 92 of the cap 90. The upper bearing flange 94 of the cap 90 is captured between the central bearing flange 84 of the hub 80 and the spray arm 22. In this manner, the upper bearing flange 94 is arranged between the spray arm 22 and the central bearing flange 84. A bearing washer (not shown) may be disposed between the upper bearing flange 94 and the central bearing flange 84.

As shown in FIG. 3, the cap 90 is connectable to the pump outlet 58. The locking tabs 96 of the cap 90 engage a plurality of slots 102 formed into the inner portion 64 of the top housing wall 66 such that the cap 90 mounts to the outlet 58 of the pump 50. It can be appreciated that the cap 90 may be connected to the pump in any know manner including through the use of fasteners, welding, or interference fitting.

When the pump 50 is pumping wash liquid through the pump outlet 58, the spray arm assembly 22 is pushed upward by the flow of wash liquid up through the cap 90 such that the flange 84 of the hub 80 engages the bearing flange 94. The bearing interface between the flanges 84 and 94 is a relatively small diameter interface such that bearing friction loss is minimized which allows the spray arm 22 to easily rotate in response to driver nozzles which may be incorporated into the spray arm in a known manner. To give the bearing connection stability, the cylindrical bottom portion 86 of the hub is captured or engaged by a bearing surface 110 formed by a plurality of ribs 112 extending inwardly from the conduit 60. In this manner, the cylindrical bottom portion 86 of the hub 80 extends into the pump outlet 58 and is engaged by a bearing surface formed within the pump outlet 58 such that the bearing interface between the spray arm 22 and the pump outlet is given axial stability.

Figure 5:
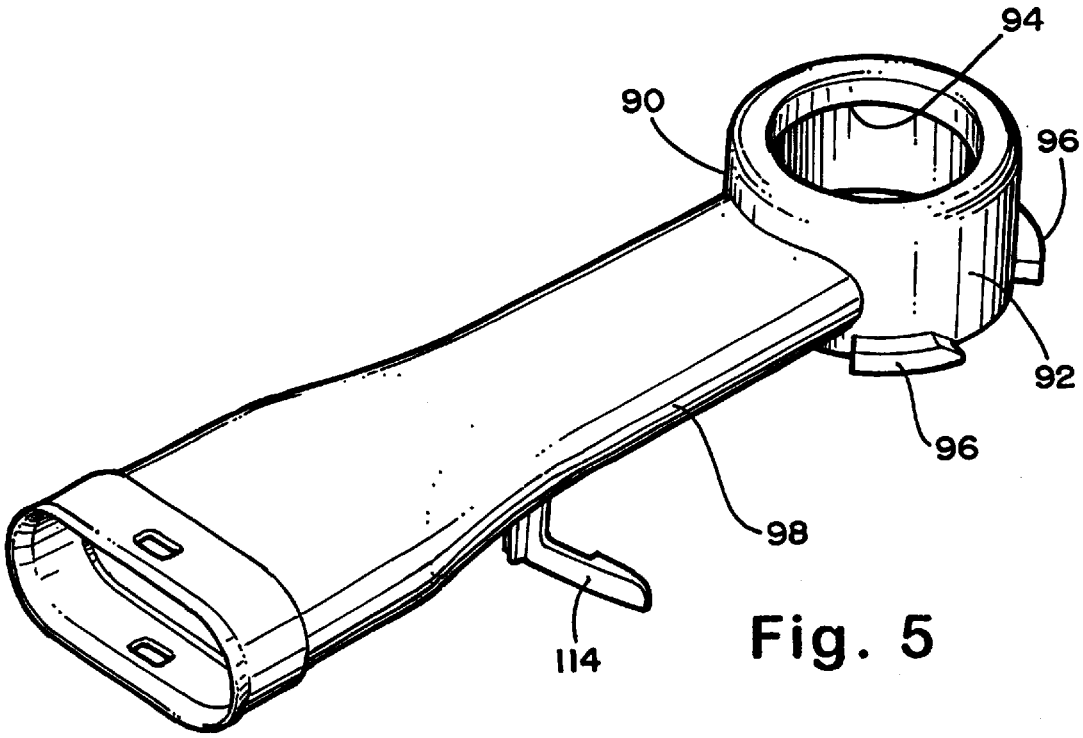
FIG. 5 is a perspective view of the cap member which forms a liquid outlet from the pump and rotatably secures the lower spray arm.

As shown in FIGS. 3 and 5, the cap 90 includes a discharge outlet conduit 98 extending outwardly from the main body portion 92. When the cap 90 is connected to the top housing wall 66, the discharge outlet conduit 98 extends rearwardly toward the back of the tub 12. When wash liquid is being pumped by the pump 50, wash liquid passes through the pump outlet 58 into the cylindrical main body portion 92 of the cap 90 wherein some of the wash liquid flows upwardly toward the spray arm 22 and some of the wash liquid is directed to flow through the discharge outlet conduit 98. The flow through the discharge outlet conduit 98 is promoted by the fact that the outlet through the top portion 82 of the hub 80 to the distributor hub 70 has a smaller cross-sectional area than lower portions of the pump outlet 58 such that the pressure within the cap 90 is increased. The discharge outlet conduit 98 is designed to connect to and form part of the supply tube 30 which extends upwardly to supply wash liquid to the upper spray arm 24.

The discharge outlet conduit 98 also includes a locking finger 114 extending from the bottom thereof. When the cap 90 is connected to the top housing wall 66 and the locking tabs 96 engage the slots 102, the locking finger 114 is designed to engage a catch provided on the top housing wall 66.

It can be understood that the cap 90 may be formed without a rear discharge conduit 90. In such a design, the hub

80 may be provided with an open top portion 82 such that wash liquid may be directed to flow into a tower mounted onto the lower rack 26.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim:

1. A dishwasher, comprising:

a tub defining a wash chamber and having a sump;

a recirculation pump supported by the tub having an inlet for drawing wash liquid from the sump and having a pump outlet provided in a housing wall, the housing wall including a plurality of locking slots;

a first spray arm located above the recirculation pump;

a cap member including a cylindrical main body having an upper bearing flange and a plurality of locking tabs disposed along the bottom edge of the main body, the locking tabs engaging the locking slots such that the cap member may be secured to the housing wall without the use of fasteners such that the cap member is connected to the pump outlet and rotatably engaging the first spray arm such that the first spray arm is rotatably connected to the outlet, the cap member having a discharge outlet;

a supply line extending from the discharge outlet and secured to the tub; and a second spray arm supported above the first spray arm, the second spray arm receiving wash liquid from the supply line.

2. The dishwasher according to claim 1, wherein the discharge outlet forms a discharge outlet conduit extending rearwardly from the cap member for fluidly connecting with the supply line.

3. The dishwasher according to claim 2, further comprising:

a housing wall is provided above the recirculation pump, and the pump outlet extends through the housing wall, wherein the discharge outlet conduit includes a locking finger which engages a catch formed into the housing wall.

4. A dishwasher, comprising:

a tub defining a wash chamber and having a sump;

a recirculation pump having an inlet for drawing wash liquid from the sump and having a pump outlet;

a first spray arm located above the recirculation pump;

a hub member connectable to the spray arm, the hub member having a bearing flange, a cap member connected to the pump outlet and including a bearing surface which is arranged between the bearing flange of the hub member and the spray arm such that the cap member is rotatably secured to the spray arm allowing the spray arm to rotate relative to the cap member such that the first spray arm is rotatably connected to the outlet, the cap member having a discharge outlet;

a supply line extending from the discharge outlet and secured to the tub; and a second spray arm supported above the first spray arm, the second spray arm receiving wash liquid from the supply line.

5. A dishwasher, comprising:

a tub defining a wash chamber and having a sump;

a recirculation pump having an inlet for drawing wash liquid from the sump and having a pump outlet;

a first spray arm located above the recirculation pump;

a hub member having a generally tubular body which includes a top portion, a central bearing flange and a cylindrical bottom portion, the top portion being connectable to the first spray arm such that the hub member extends downwardly from the first spray arm;

a bearing surface formed within the pump outlet;

a cap member connected to the pump outlet including a bearing surface which is arranged between the bearing flange of the hub member and the spray arm such that the cap member is rotatably secured to the spray arm allowing the spray arm to rotate relative to the cap member such that the first spray arm is rotatably connected to the outlet and wherein the cylindrical bottom portion of the hub extends downwardly into the pump outlet and engages the bearing surface such that the cylindrical bottom portion is radially constrained, the cap member having a discharge outlet;

a supply line extending from the discharge outlet and secured to the tub; and a second spray arm supported above the first spray arm, the second spray arm receiving wash liquid from the supply line.

6. A recirculation system for a dishwasher having a tub having a sump and supporting a lower and upper dishware rack, the recirculation system comprising:

a pump having an inlet and an outlet, the pump drawing wash liquid from the sump and pumping through the outlet;

a spray arm rotatably supported above the pump for receiving wash liquid from the pump;

a hub member connectable to the spray arm, the hub member having a bearing flange;

a cap connected to the pump outlet including a bearing surface which is arranged between the bearing flange of the hub member and the spray arm such that the cap is rotatably secured to the spray arm allowing the spray arm to rotate relative to the cap member, the cap having a discharge outlet for directing some of wash liquid passing through the pump outlet away from the spray arm.

7. The recirculation system for a dishwasher according to claim 6, further wherein the discharge outlet forms a discharge outlet conduit extending rearwardly from the cap for fluidly connecting with a supply line extending from the discharge outlet conduit and secured to the tub; and a second spray arm supported above the spray arm, the second spray arm receiving wash liquid from the supply line.

8. The recirculation system for a dishwasher according to claim 7, further comprising:

a housing wall provided above the pump, and the pump outlet extending through the housing wall, wherein the discharge outlet conduit includes a locking finger which engages a catch formed into the housing wall.

9. A recirculation system for a dishwasher having a tub having a sump and supporting a lower and upper dishware rack, the recirculation system comprising:

a pump having a housing wall disposed above the pump including a plurality of locking slots, an inlet and an outlet, the pump drawing wash liquid from the sump and pumping through the outlet;

a spray arm rotatably supported above the housing wall for receiving wash liquid from the pump; and a cap including a cylindrical main body having an upper bearing flange and a plurality of locking tabs disposed along the bottom edge of the main body, the locking tabs engaging the locking slots such that the cap may be secured to the housing wall without the use of fasteners and rotatably engaging the spray arm, the cap having a discharge outlet for directing some of wash liquid passing through the pump outlet away from the spray arm.

10. A recirculation system for a dishwasher having a tub having a sump and supporting a lower and upper dishware rack, the recirculation system comprising:

a pump having an inlet and an outlet and the pump outlet includes a bearing surface, the pump drawing wash liquid from the sump and pumping through the outlet;

a spray arm rotatably supported above the pump for receiving wash liquid from the pump; and a cap connected to the pump outlet and rotatably engaging the spray arm, the cap having a discharge outlet for directing some of wash liquid passing through the pump outlet away from the spray arm, wherein the spray arm includes a hub extending downwardly through the cap, the hub having a lower end which engages the bearing surface within the pump outlet.

11. A recirculation system for a dishwasher having a tub having a sump and supporting a lower and upper dishware rack, the recirculation system comprising:

a pump having an inlet and an outlet, a bearing surface formed within the pump outlet, the pump drawing wash liquid from the sump and pumping through the outlet;

a spray arm rotatably supported above the pump for receiving wash liquid from the pump;

a hub member having a generally tubular body which includes a top portion, a central bearing flange and a cylindrical bottom portion, the top portion being connectable to the spray arm such that the hub member depends from the spray arm; and a cap connected to the pump outlet and rotatably engaging the spray arm, the cap having a discharge outlet for directing some of wash liquid passing through the pump outlet away from the spray arm, wherein the cap member includes a bearing surface which is arranged between the bearing flange of the hub member and the spray arm such that the cap member is rotatably secured to the spray arm allowing the spray arm to rotate relative to the cap member, and wherein the cylindrical bottom portion of said hub extends downwardly into the pump outlet and engages the bearing surface such that the cylindrical bottom portion is radially constrained.

12. A dishwashing machine including a tub for receiving articles to be washed and a pump for spraying wash liquid within the tub such that wash liquid is recirculated within the tub, the dishwasher comprising:

a cap member arranged in the bottom of the tub defining a main wash liquid outlet for the pump;

a spray arm disposed within the tub above the cap member;

a hub member attached to the spray arm extending downwardly from the spray arm, the hub member having a bearing surface;

the cap member having an annular bearing surface arranged between the hub bearing surface and the spray arm such that the spray arm is rotatably supported by the cap member, the cap member further having a discharge outlet conduit wherein a portion of the wash liquid supplied to the cap member is directed through the discharge outlet away from the main liquid outlet.

13. The dishwashing machine according to claim 12, further comprising:

a top housing wall disposed beneath the cap wherein the cap member is locked to the top housing wall to form part of the main wash liquid outlet without the use of fasteners.

14. The dishwashing machine according to claim 13, further wherein:

the top housing wall including a plurality of locking slots, and the cap member includes a cylindrical main body having an upper bearing flange and a plurality of locking tabs disposed along the bottom edge of the main body, the locking tabs engage the locking slots such that the cap may be secured to the housing wall without the use of fasteners.

15. The dishwashing machine according to claim 12, further comprising:

a supply line extending from the discharge outlet and secured to the tub; and a second spray arm supported above the spray arm, the second spray arm receiving wash liquid from the supply line.

16. The dishwasher machine according to claim 12, further comprising:

a hub member having a generally tubular body which includes a top portion, a central bearing flange and a cylindrical bottom portion, the top portion being connectable to the spray arm such that the hub member depends from the spray arm; and a bearing surface formed within the pump outlet, wherein the cap member includes a bearing surface which is arranged between the bearing flange of the hub member and the spray arm such that the cap member is rotatably secured to the spray arm allowing the spray arm to rotate relative to the cap member, and wherein the cylindrical bottom portion extends downwardly into the pump outlet and engages the bearing surface such that the cylindrical bottom portion is radially constrained.

* * * * *